US011259650B2

(12) United States Patent
Tsui et al.

(10) Patent No.: US 11,259,650 B2
(45) Date of Patent: Mar. 1, 2022

(54) SYSTEMS, METHODS, AND APPARATUSES FOR A CONVERTIBLE CHILD BOOSTER'S SEAT

(71) Applicant: GRACO CHILDREN'S PRODUCTS, INC., Atlanta, GA (US)

(72) Inventors: Siu-Lok Tsui, Atlanta, GA (US); Sarah Elizabeth Congdon-Martin, Wyomissing, PA (US); Brian Scott Kelly, Alpharetta, GA (US); Rachael Auline Knapp, Atlanta, GA (US); Connie Yuanfang Gu, Atlanta, GA (US)

(73) Assignee: Graco Children's Products, Inc., Atlanta, GA (US)

( * ) Notice: Subject to any disclaimer, the term of this patent is extended or adjusted under 35 U.S.C. 154(b) by 0 days.

(21) Appl. No.: 16/897,883

(22) Filed: Jun. 10, 2020

(65) Prior Publication Data

US 2020/0390249 A1 Dec. 17, 2020

Related U.S. Application Data

(60) Provisional application No. 62/860,044, filed on Jun. 11, 2019.

(51) Int. Cl.
*A47D 1/10* (2006.01)
*A47D 1/00* (2006.01)

(52) U.S. Cl.
CPC ..... *A47D 1/103* (2013.01); *A47D 1/002* (2013.01); *A47D 1/006* (2013.01); *A47D 1/0085* (2017.05)

(58) Field of Classification Search
None
See application file for complete search history.

(56) References Cited

U.S. PATENT DOCUMENTS 2,247,269 A * 6/1941 Ashbacker ..... A47C 1/16 297/350
5,752,738 A * 5/1998 Onishi ..... B62B 9/104 297/61
5,951,102 A * 9/1999 Poulson ..... A47D 1/10 297/130

(Continued)

FOREIGN PATENT DOCUMENTS

GB 876359 A * 8/1961 ..... A47C 1/16

*Primary Examiner* — David E Allred
(74) *Attorney, Agent, or Firm* — Eversheds Sutherland (US) LLP

(57) ABSTRACT

A booster seat can be configured to be adjusted from a full or home booster configuration to a travel configuration or a backless booster configuration. In the full configuration, the booster seat can include a seat base, a seat shell movably coupled to and configured to recline with respect to the seat base, a seat back removably coupled to the seat shell, and soft goods that cover portions of the seat back and the seat shell. In the travel configuration, for example, the booster seat can include the seat back and soft goods without the seat shell and the seat base. In the backless booster configuration, the booster seat can include the seat base and the seat shell without the seat back (e.g., decoupling the seat back from the seat shell). Multiple modes of the booster seat allows for continued use of the seat as the child grows and when travelling.

17 Claims, 15 Drawing Sheets

(56) References Cited

U.S. PATENT DOCUMENTS

| | | | | |
|---|---|---|---|---|
| 6,033,019 | A * | 3/2000 | Hession-Kunz | A47D 1/002 297/250.1 |
| 6,454,352 | B1 * | 9/2002 | Konovalov | B60N 2/2881 297/219.12 |
| 7,530,635 | B2 * | 5/2009 | Schramek-Flye | A47D 1/103 297/17 |
| 7,578,551 | B2 * | 8/2009 | Linero | A47C 1/122 297/107 |
| 7,810,682 | B2 * | 10/2010 | Balensiefer | B60N 2/2806 224/158 |
| 7,854,476 | B1 * | 12/2010 | Liu | A47D 1/103 297/181 |
| 9,610,869 | B1 * | 4/2017 | Holley, Jr. | B60N 2/2812 |
| 2002/0014794 | A1 * | 2/2002 | Chow | A61G 5/1045 297/219.12 |
| 2003/0102702 | A1 * | 6/2003 | Daley | B60N 2/2821 297/250.1 |
| 2004/0207239 | A1 * | 10/2004 | King | B60N 2/2839 297/219.12 |
| 2004/0245822 | A1 * | 12/2004 | Balensiefer, II | B60N 2/2851 297/250.1 |
| 2009/0001776 | A1 * | 1/2009 | Bearup | A47D 1/004 297/153 |
| 2009/0189425 | A1 * | 7/2009 | Powell | A47C 31/113 297/219.12 |
| 2010/0314915 | A1 * | 12/2010 | Mills | B62B 9/142 297/188.01 |
| 2011/0181084 | A1 * | 7/2011 | Arnold, IV | A47D 15/006 297/256.16 |

* cited by examiner

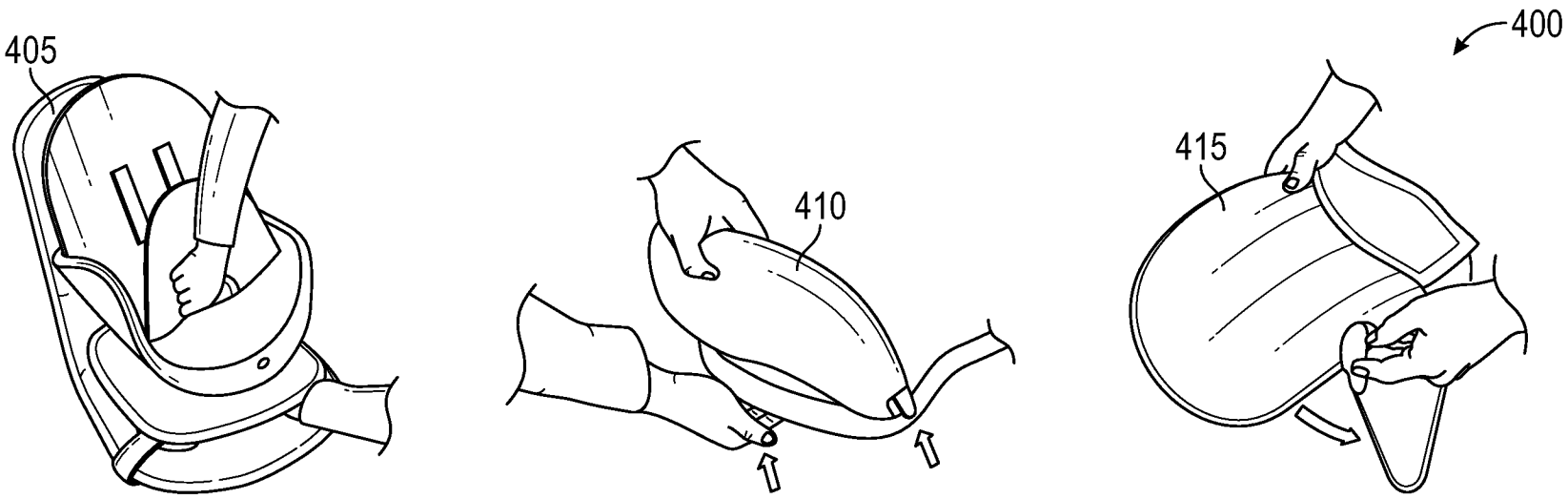
FIG. 4C
FIG. 4B
FIG. 4A
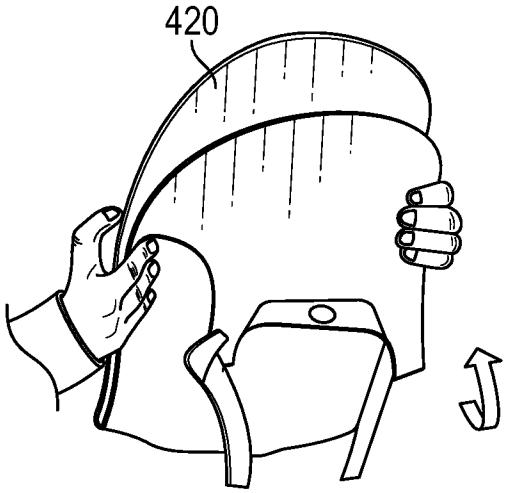
FIG. 4D
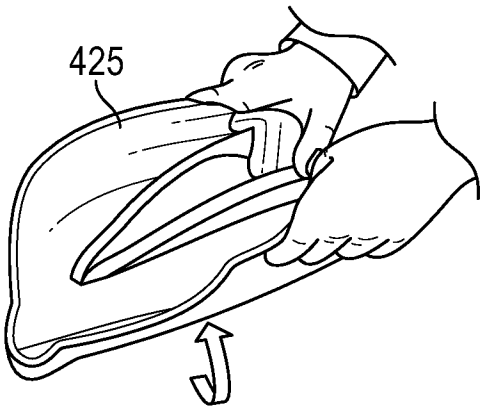
FIG. 4E

SYSTEMS, METHODS, AND APPARATUSES FOR A CONVERTIBLE CHILD BOOSTER'S SEAT

RELATED APPLICATIONS

This application claims priority under 35 U.S.C. § 119 to U.S. Provisional Patent Application No. 62/860,044 filed Jun. 11, 2019, and titled "SYSTEMS, METHODS, APPARATUSES FOR A CONVERTIBLE CHILD'S BOOSTER SEAT," the entire contents of which are hereby incorporated herein by reference for all purposes.

TECHNICAL FIELD

The present disclosure is generally directed to children's booster seats and more particularly to systems, apparatuses, and methods for providing a booster seat that can be converted into multiple operational modes for use at home and while traveling.

BACKGROUND

Children's booster seats are well-known in the art. The typical children's booster seat is designed to provide an infant, toddler, or child with an elevated seating position and can be positioned on top of conventional chairs. Some conventional booster seats include a tray or similar device that can be removably coupled to the booster seat and can be used as a place to set down food and/or drinks for the child.

While booster seats in the home are useful, in many cases a similar booster seat is also needed when parents or caregivers take the child to a restaurant or are travelling. While some restaurants may have booster seats, many do not, and the cleanliness of those booster seats being provided can easily be called into question. Further, when visiting relatives or friends during travel, it is difficult to assume they will have a booster for the visitor's child. Booster seats are often bulky, which makes storing them and permitting the user to take them along when traveling very difficult. In addition, as the child gets older, the features they require from a booster seat can change. For example, they may no longer need the tray, since a toddler may be eating from the table. Further, the toddler may not need a back to the booster as they are now able to sit upright on their own.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIGS. 4A-4E and 5A-5D are a series of images presenting a method for converting the convertible booster seat of FIG. 1A from a home booster configuration to a travel booster configuration in accordance with one example embodiment of the disclosure.

DETAILED DESCRIPTION OF THE EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain relationships between features of the convertible booster seat are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

Figure 1A:
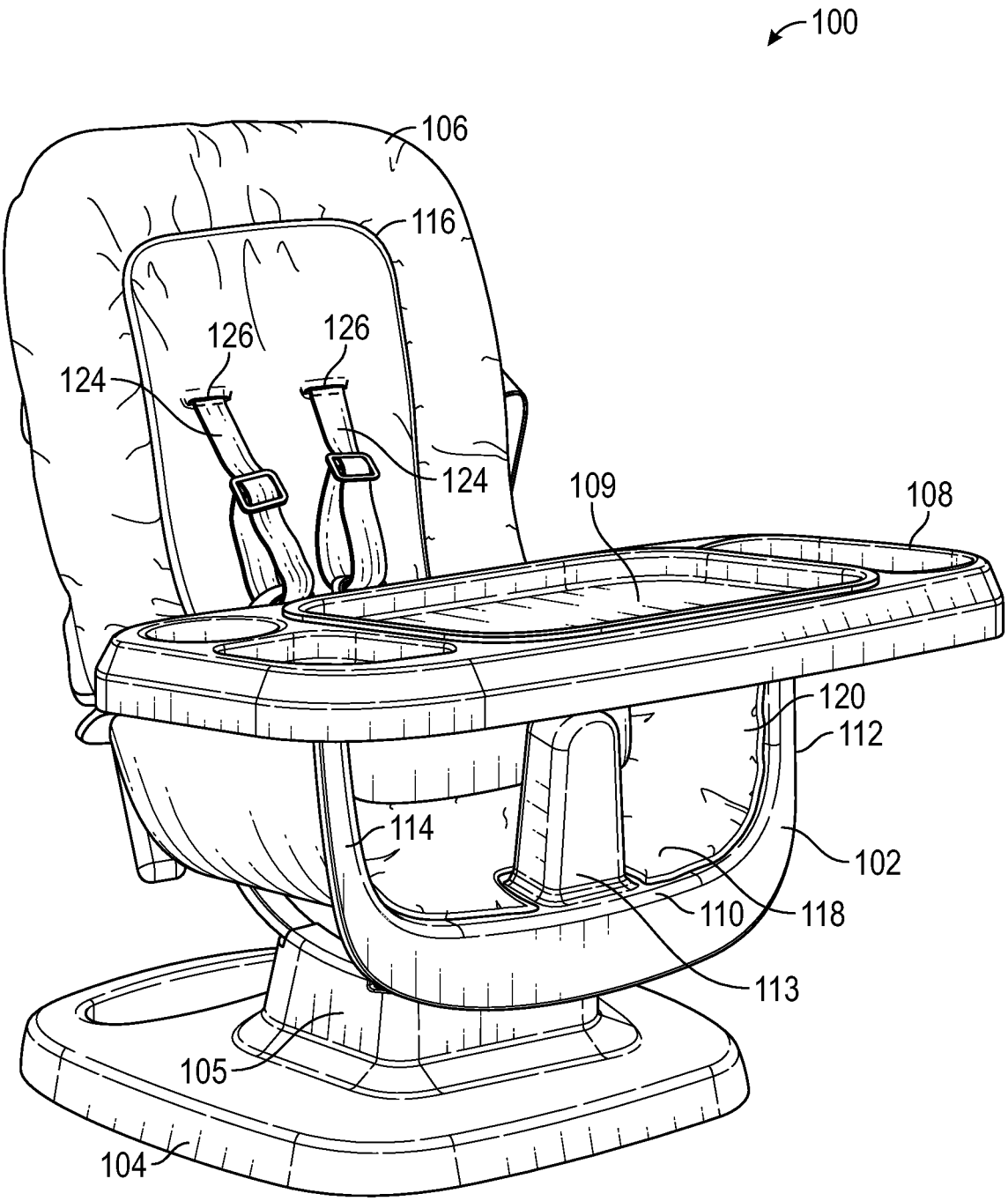
FIG. 1A is front perspective view of a convertible booster seat in the home booster configuration in accordance with one example embodiment of the disclosure.
Figure 1B:
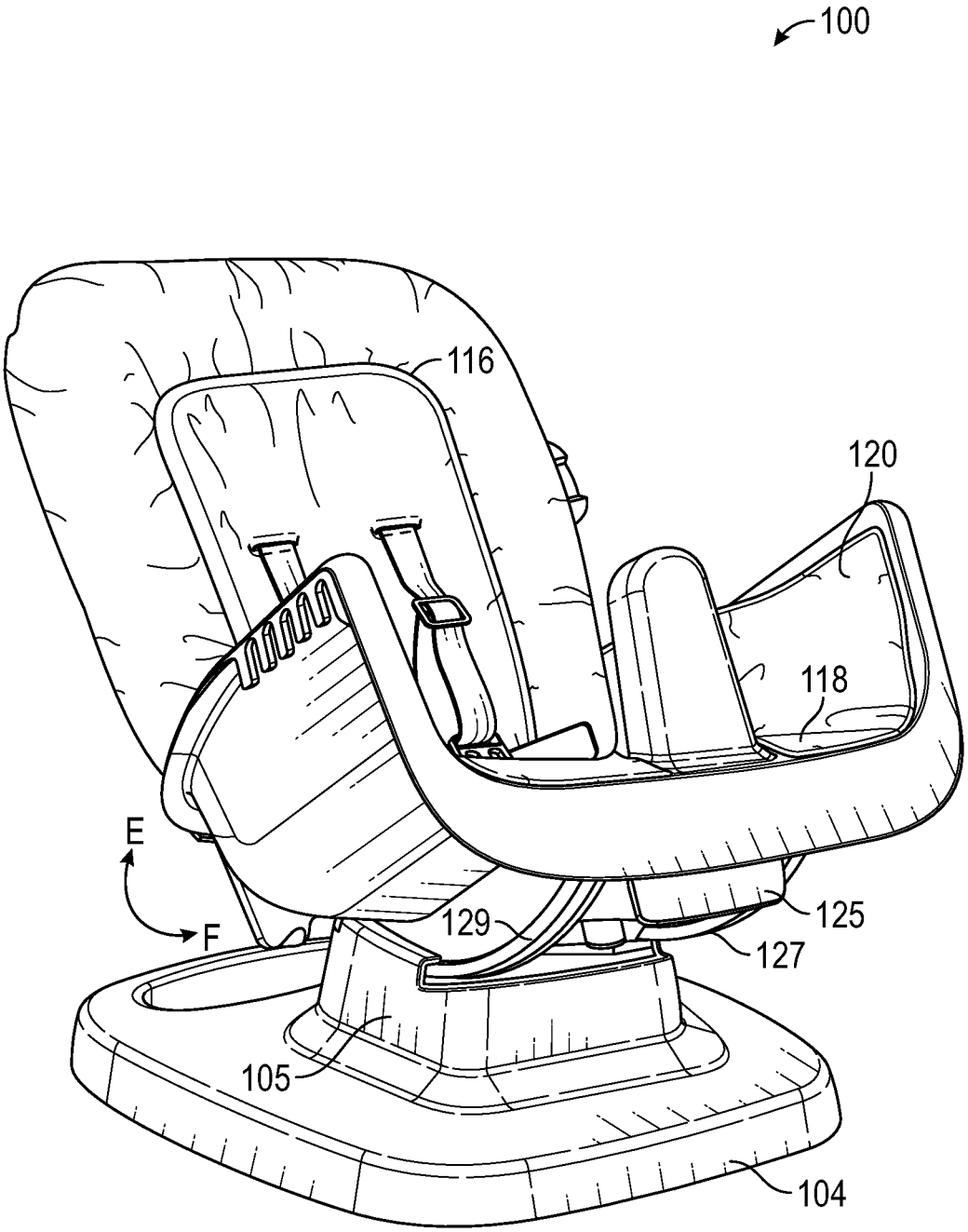
FIG. 1B is another front perspective view of the convertible booster seat of FIG. 1A showing the seat bottom tilted with respect to the seat base in accordance with one example embodiment of the disclosure.

FIGS. 1A-1B are perspective views of a convertible booster seat 100 in the home booster configuration in accordance with one example embodiment of the disclosure. FIGS. 1C-1K are various additional views of all or portions of the convertible booster seat 100 of FIG. 1A in accordance with one example embodiment of the disclosure. Referring now to FIGS. 1A-1K, the convertible booster seat 100 can include a seat shell 102. The seat shell 102 can be constructed of plastic, metal, any other material, or a combination thereof. In one example, the seat shell 102 is constructed from one or more pieces of molded plastic. The seat shell 102 can be sized and shaped to permit an infant or toddler (e.g., a child) to sit thereon and/or therein.

The seat shell 102 can include a seat bottom 110. The seat bottom 110 can have a flat or contoured top surface configured to have a child sit thereon. The seat shell 102 can also include a first side panel 112 extending up from the seat bottom 110 in a vertical or substantially vertical direction along a first lateral side of the seat shell 102, and a second side panel 114 extending up from the seat bottom 110 in a vertical or substantially vertical direction along a second lateral side opposite the first lateral side of the seat shell 102. In certain example embodiments, the top end of each of the first side panel 112 and second side panel 114 can further include or define arm rests along a top end of each of the first side panel 112 and the second side panel 114. In addition, the top ends of the first side panel 112 and the second side panel 114 can include elongated slots, rails, tracks, or other attachment mechanisms for removably coupling a tray 108 to the seat shell 102.

In certain example embodiments, the seat shell 102 can also include a crotch post 113 extending up from the seat bottom 110 in a vertical or substantially vertical direction between the first side panel 112 and the second side panel 114. In one example, the crotch post 113 is positioned laterally at a midpoint between the first side panel 112 and the second side panel 114 and is generally positioned near or adjacent to the front end of the seat shell 102.

Figure 1C:
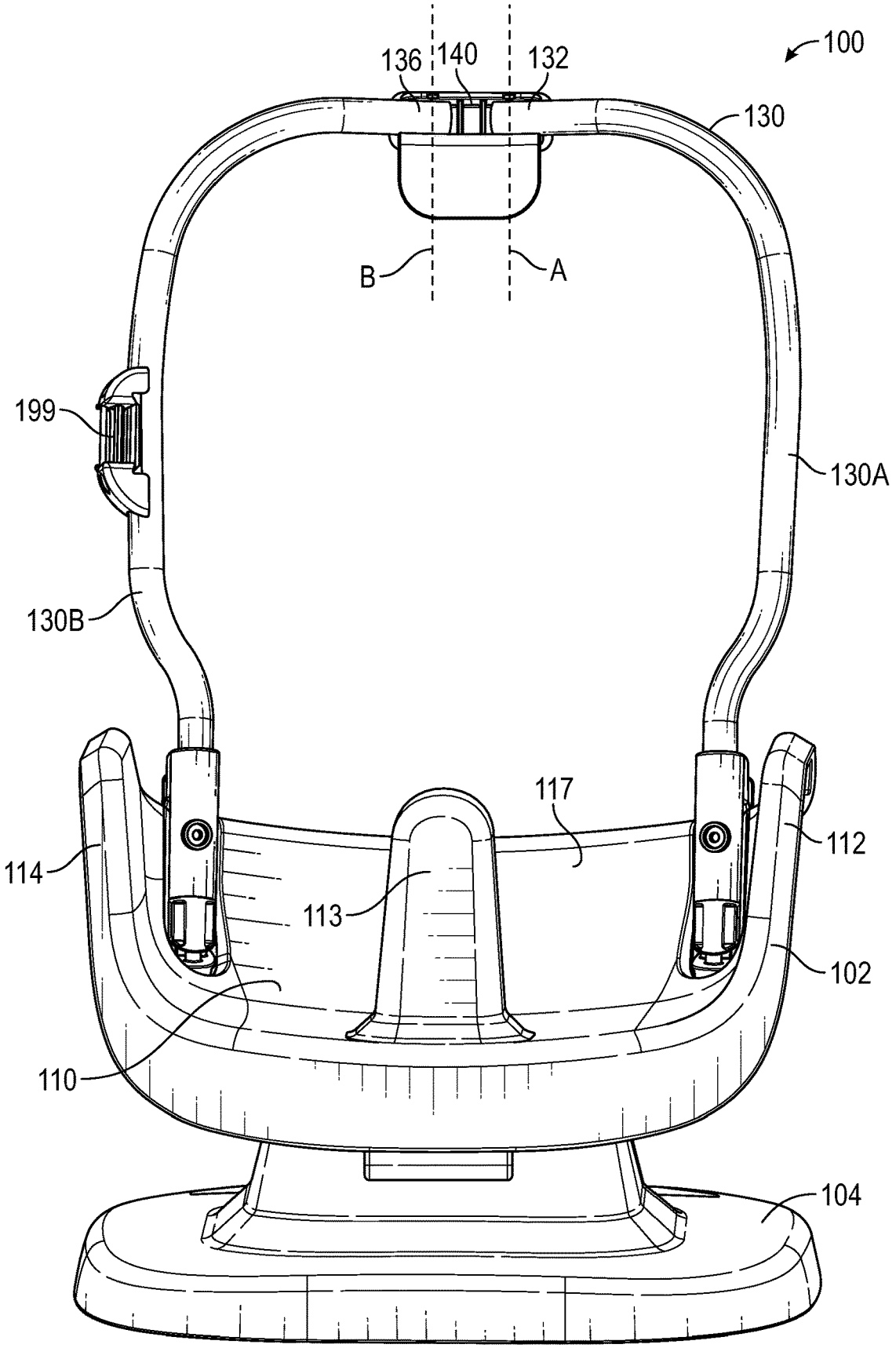
FIG. 1C is front elevation view of the convertible booster seat of FIG. 1A with the soft goods removed to show internal framing in accordance with one example embodiment of the disclosure.
Figure 1D:
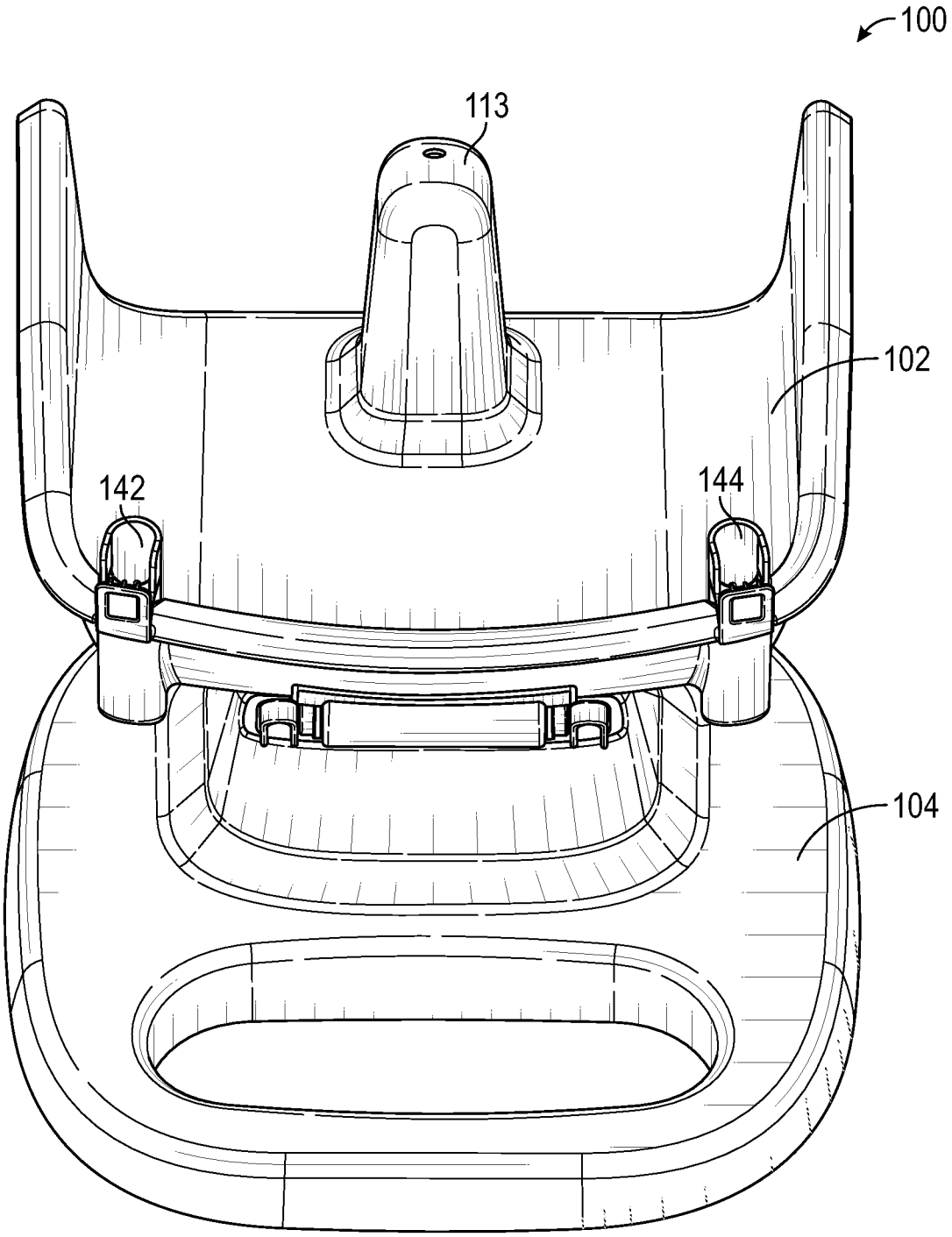
FIG. 1D is a partial rear perspective view of the convertible booster seat of FIG. 1A with the seat back framing removed from the seat shell in accordance with one example embodiment of the disclosure.

As best shown in FIG. 1C, the seat shell 102 can also include a first seat back portion 117. The first seat back portion 117 can have a height that is less than the height of the first side panel 112 and the second side panel 114. In certain example embodiments, the first seat back portion 117 has a height from the seat bottom 110 to the top end of the first seat back portion 117 that is less than six inches and preferably less than four inches. The first seat back portion 117 can include receiving slots 142, 144 (see FIG. 1E) for coupling a second seat back portion 106 thereto.

The seat bottom 110, first side panel 112, second side panel 114, first seat back portion 117, and crotch post 113 can be integrally formed with one another in certain example embodiments. In other embodiments, the seat bottom 110, first side panel 112, second side panel 114, first seat back portion 117, and crotch post 113 can be separately formed and coupled together. The seat bottom 110, first side panel 112, second side panel 114, and first seat back portion 117 can together form a receiving surface for receiving a child therein and keeping the child within the convertible booster seat 100.

The convertible booster seat 100 can also include a second seat back portion 106. The second seat back portion 106 can extend generally up from adjacent the rear end of the seat shell 102 opposite the front end. For example, the second seat back portion 106 can extend generally up from the first seat back portion 117 of the seat shell 102. In certain example embodiments, the second seat back portion 106 can be removably coupled to the first seat back portion 117 or can be removably coupled to the rear ends of the first side panel 112 and second side panel 114. In certain example embodiments, the second seat back portion 106 is removably coupled to the first seat back portion 117 of the seat shell 102 such that the second seat back portion 106 can be removed and reattached to the seat shell 102 by a user as needed.

As best shown in FIG. 1C, in one example embodiment, the second seat back portion 106 can include a seat back frame 130. The seat back frame 130 can be made up of one or more tubular or solid rods or members coupled together to provide either a general outline of the second seat back portion 106 or also internal bracing members of the second seat back portion 106. For example, the seat back frame 130 can include a first seat back frame member 130A and a second seat back frame member 130B. The first seat back frame member 130A can be coupled directly or indirectly to the second seat back frame member 130B. Further, in certain embodiments, the first seat back frame member 130A is rotatable with respect to the second seat back frame member 130B. In this example, the first seat back frame member 130A includes a first end 132 and a distal second end 134. The first end 132 can be coupled to a hinge 140 or a member that includes a hinge.

The second seat back frame member 130B can include a first end 136 and a distal second end 138. The first end 136 can be position adjacent the first end 132 of the first seat back frame member 130A and also coupled to the hinge 140 or a member that includes a hinge. The first seat back frame member 130A can rotate about the axis A with respect to the second seat back frame member 130B and/or the hinge 140 and the second seat back frame member 130B can rotate about the axis B with respect to the first seat back frame member 130A and/or the hinge 140. In other example embodiments, the hinge 140 can be designed such that the first seat back frame member 130 and the second seat back frame member 130B rotate about the same axis. In one example, the first seat back frame member 130A, second seat back frame member 130B, and the hinge 140 define an outer perimeter of the seat back frame 130.

Figure 1E:
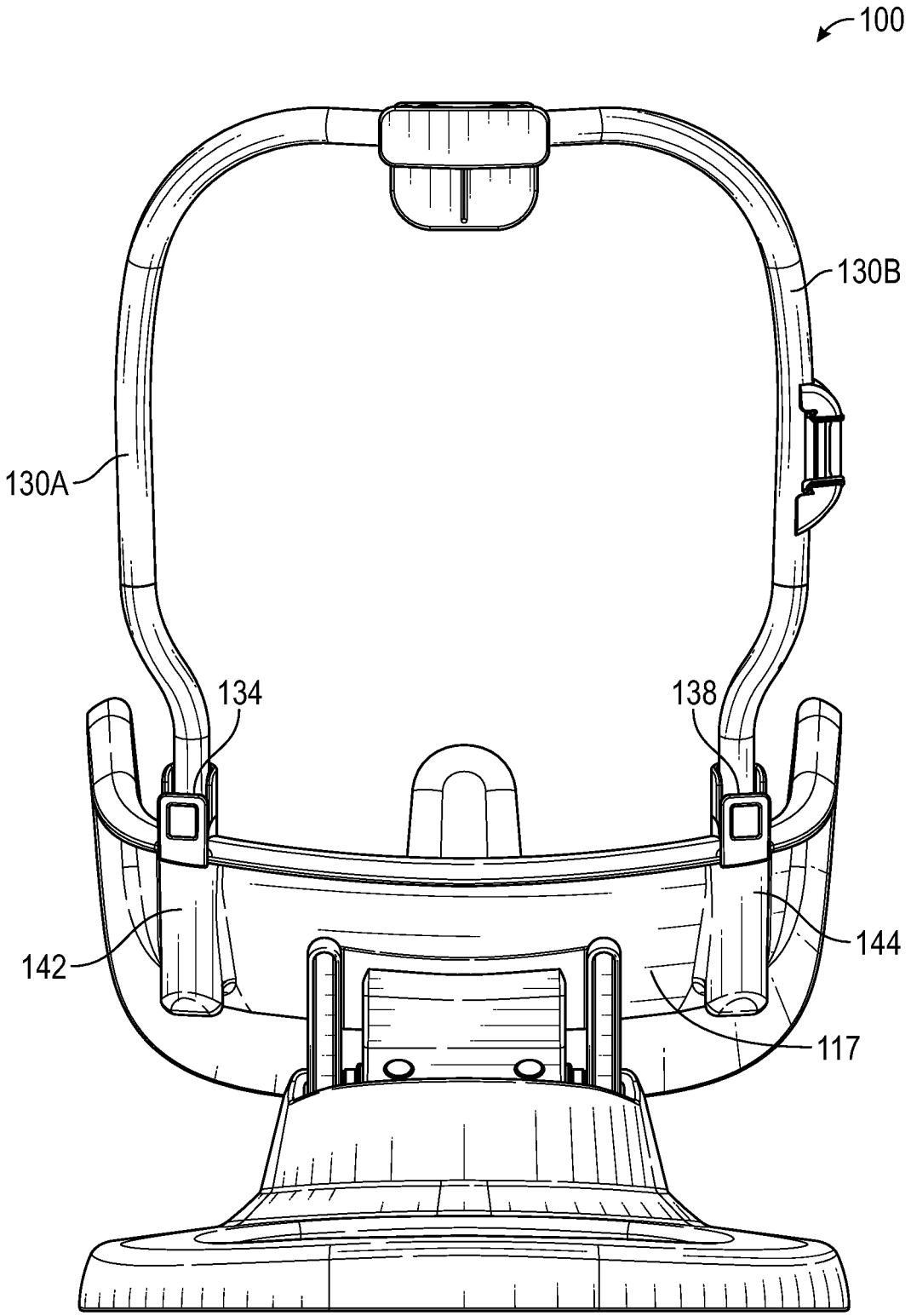
FIG. 1E is a rear elevation view of the convertible booster seat of FIG. 1A with the seat back framing attached to the seat shell in accordance with one example embodiment of the disclosure.
Figure 1F:
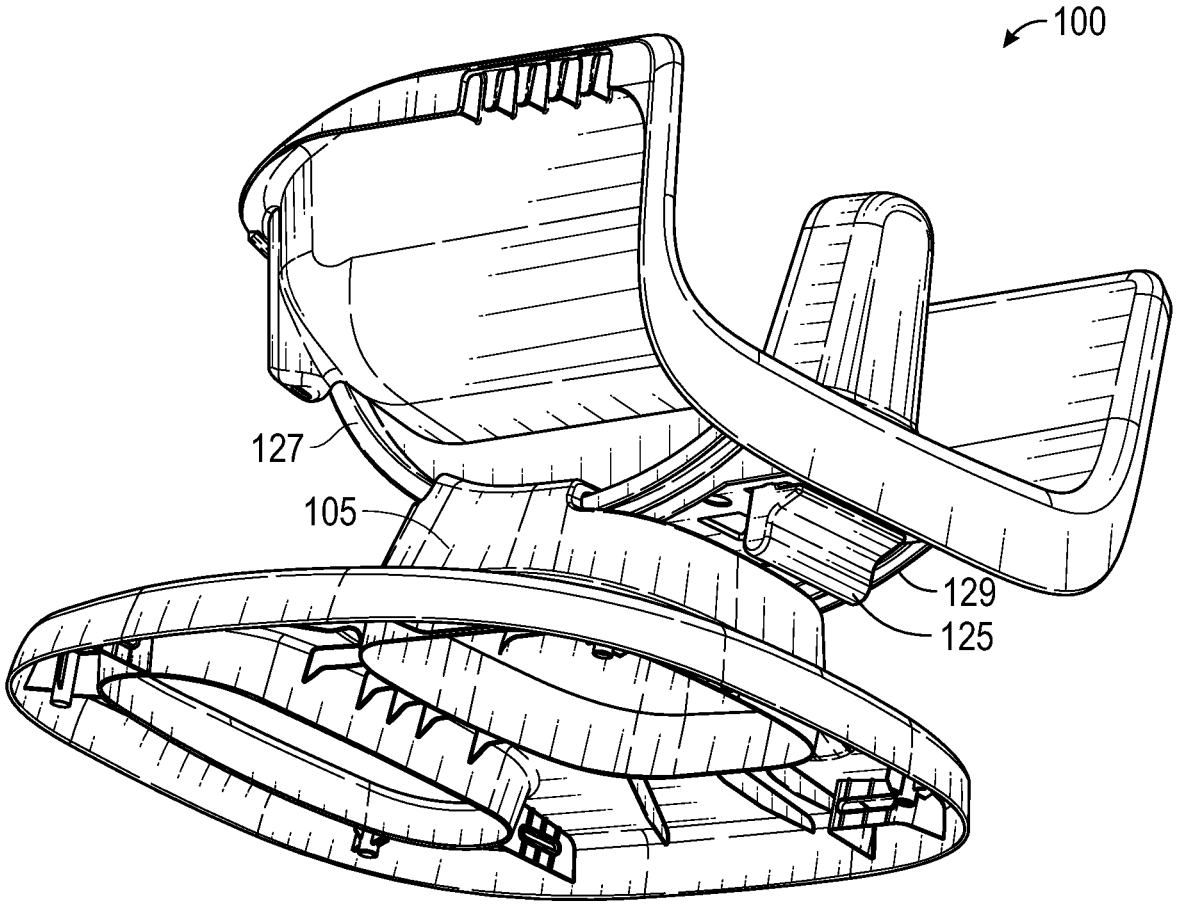
FIG. 1F is a partial perspective view of the convertible booster seat of FIG. 1A in accordance with one example embodiment of the disclosure.
Figure 1H:
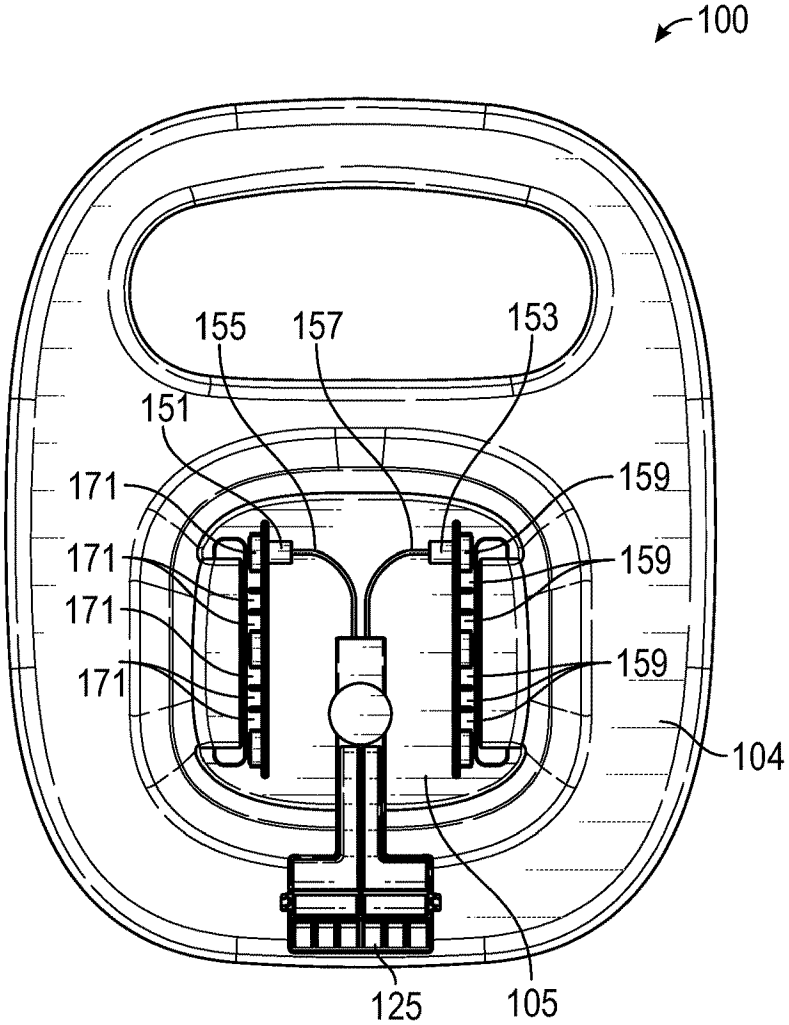
FIG. 1H is a partial cross-sectional top view of the seat shell and the seat base of the convertible booster seat of FIG. 1A in accordance with one example embodiment of the disclosure.
Figure 1G:
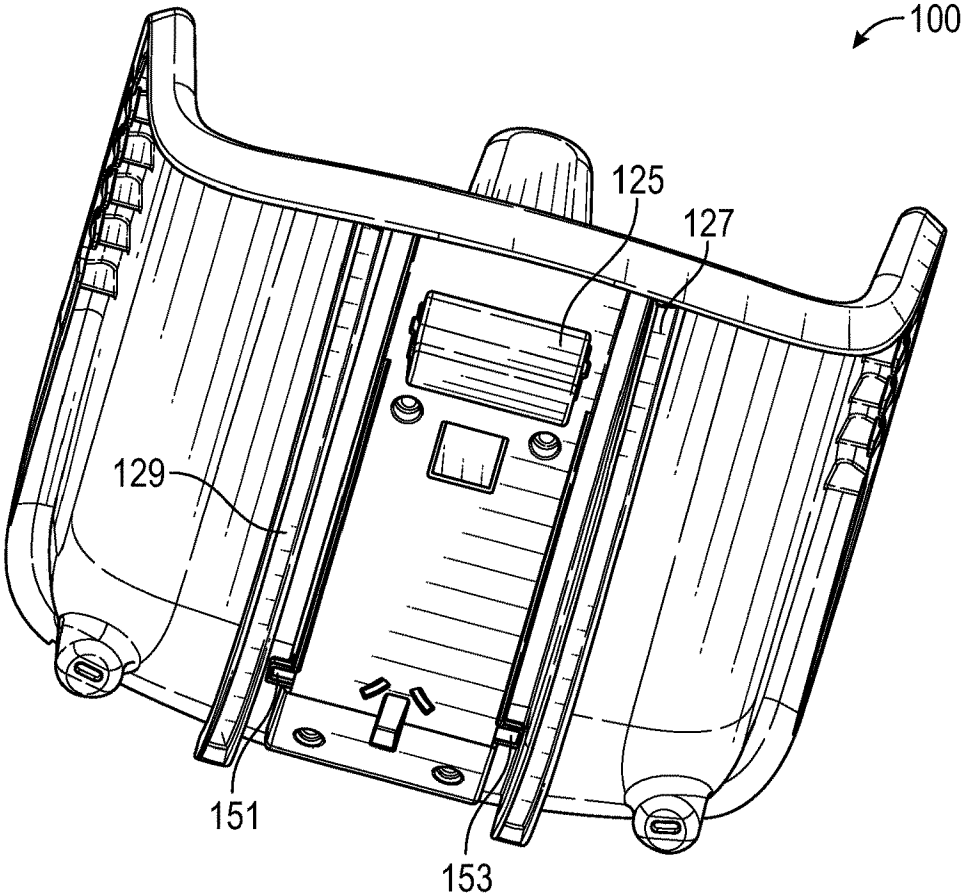
FIG. 1G is a partial bottom perspective view of the seat shell of the convertible booster seat of FIG. 1A in accordance with one example embodiment of the disclosure.

As best shown in FIG. 1E, the second end 134 of the first seat back frame member 130A can be inserted into a first frame receiving aperture 142 along the first seat back portion 117 and the second end 138 of the second seat back frame member 130B can be inserted into a second frame receiving aperture 144 along the first seat back portion 117 of the seat shell 102 to removably couple the second seat back portion 106 to the first seat back portion and/or the seat shell 102. In one example, each of the first frame receiving aperture 142 and the second frame receiving aperture 144 can define a cavity that extends generally vertically through the first seat back portion 117. In certain examples, each of the first frame receiving aperture 142 and the second frame receiving aperture 144 can be configured to receive a portion of the second seat back portion 106 to removably couple the second seat back portion 106 to the seat shell 102.

In addition, each of the first frame receiving aperture 142 and the second frame receiving aperture 144 can include one or more mechanisms for coupling the second seat back portion 106 to the first seat back portion 117 to restrict the removal of second seat back portion 106. For example, each of the first frame receiving aperture 142 and second frame receiving aperture 144 can include a cam mechanism that permits a user to press the second seat back portion 106 into the apertures 142, 144 to hold it in the first seat back portion 117 and then to apply a second downward force on the second seat back portion 106 with respect to the first seat back portion 117 to release the second seat back portion 106 from the first frame receiving aperture 142 and the second frame receiving aperture 144. In another embodiment, a ball and detent system can be used to couple and decouple the second seat back portion 106 to the first frame receiving aperture 142 and the second frame receiving aperture 144 in the first seat back portion 117. In another embodiment, the second seat back portion 106 can be press-fit into the first frame receiving aperture 142 and the second frame receiving aperture 144. While the example embodiment of FIG. 1A-1K present a seat back frame 130 made of two members 130A, 130B and a hinge member 140, in other example embodiments, the seat back frame 130 can be constructed of one or more than two pieces. Further, in other example embodiments, the seat back frame 130 can in other embodiments be constructed of molded plastic or a combination of plastic and metal and can define more than just the outer perimeter of the second seat back portion 106.

The convertible booster seat 100 can also include a tray 108. The tray 108 can be removably coupled to and decoupled from the seat shell 102. For example, the tray 108 can be removably coupled to and decoupled from the seat shell 102 along each of the first side panel 112 and second side panel 114. The tray 108 can include a top surface, a substantial portion of which is generally flat and configured to receive cups, plates, and utensils thereon. In certain example embodiments, the tray 108 can include multiple cavities provided along the top surface. Each cavity can have the same or a different shape. For example, the tray can include a large, generally rectangular cavity that is configured to receive a tray insert 109. The tray insert 109 can be inserted and removed from this cavity and can include a top surface that is substantially flat except for a raised perimeter edge. The removably tray insert 109 will allow a user to more easily clean the primary surface upon which the child's food will be placed. The cavities can also include a generally circular cavity for receiving a drink product therein and other oblong cavities for utensils and other foods.

The convertible booster seat 100 can also include a seat base 104. The seat base 104 can be coupled to the seat shell 102. In certain example embodiments, the seat shell 102 is configured to rotate or tilt/recline with respect to the seat base 104 as discussed below. The seat base 104 can be positioned vertically below the seat shell 102. In other examples, the seat base 104 can be an extension of the seat shell 102 and not a separate part.

The seat base 104 can have a flat or substantially level bottom perimeter surface that is configured to rest upon a seating surface of a conventional chair 190, floor, or other surface. The bottom perimeter surface can define a cavity along the bottom side of the seat base 104 that includes bracing members that are coupled to or integrally formed with the seat base 104.

Figure 1I:
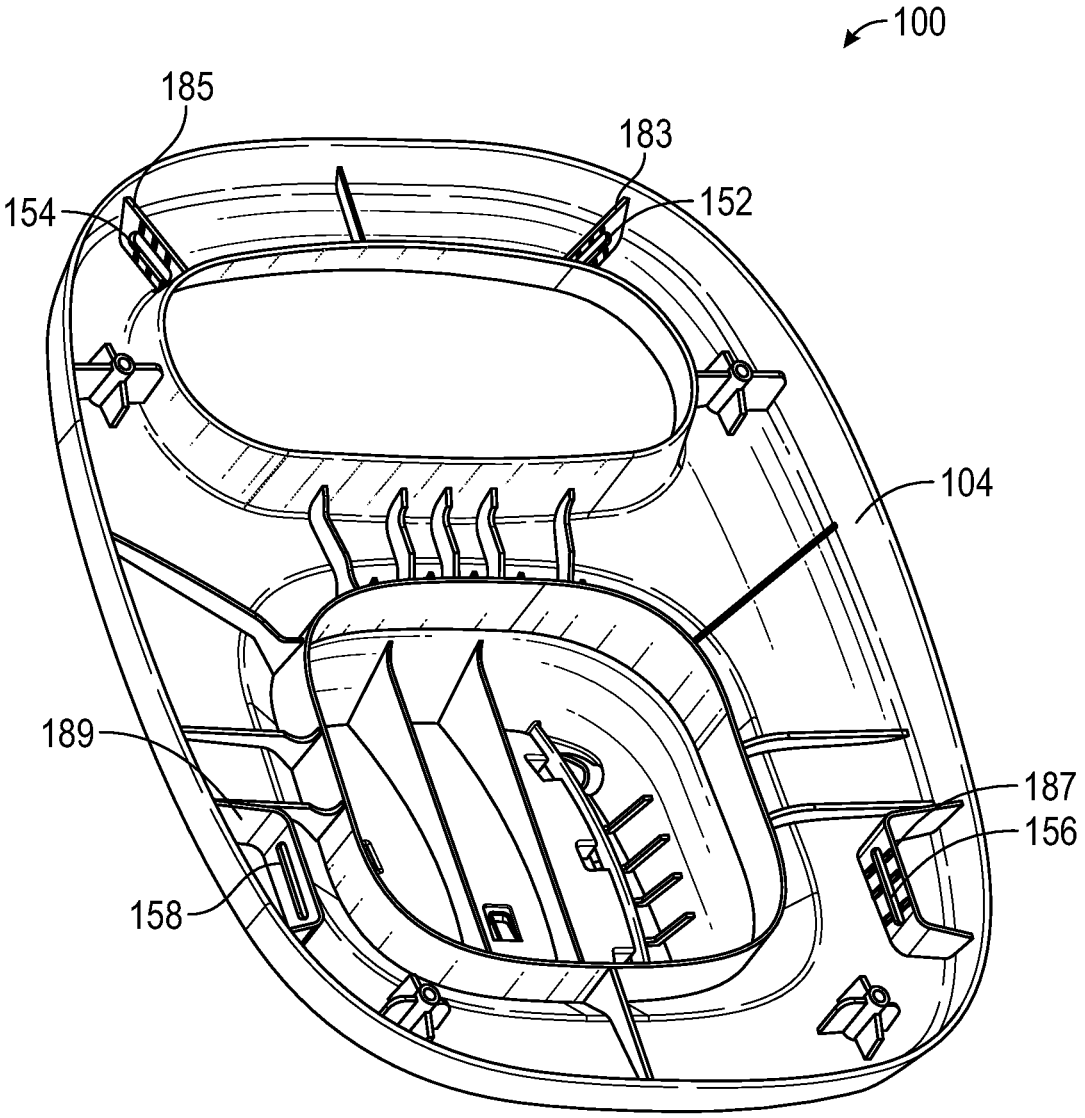
FIG. 1I is a partial bottom perspective view of the seat base of the convertible booster seat of FIG. 1A in accordance with one example embodiment of the disclosure.

As best shown in FIG. 1I, in certain example embodiments, the seat base 104 can include one or more web attachment members 183, 185, 187, 189. In certain example embodiments, the web attachment members 183, 185, 187, 189 can be positioned within the cavity along the bottom side of the seat base 104. Each web attachment member 183, 185, 187, 189 can include one or more corresponding webbing apertures 152, 154, 156, 158 that extend through or provide a webbing attachment point to the corresponding web attachment member 183, 185, 187, 189. In another embodiment, the seat base 104 may not include web attachment members and each webbing aperture 152, 154, 156, 158 can extend through a surface (e.g., the top surface or a side surface) of the seat base 104 to provide a channel from a top surface of the seat base 104 to the bottom surface of the seat base 104.

Each webbing aperture 152, 154, 156, 158, can be sized and shaped to receive webbing (e.g., straps) therethrough to assist in retaining the convertible booster seat 100 to a conventional seat 190 or other product. While the example embodiment of FIG. 1I shows four webbing apertures 152, 154, 156, 158, this is for example purposes only as fewer or greater than four webbing apertures may be provided and may be positioned on other portions of the convertible booster seat 100.

Figure 1J:
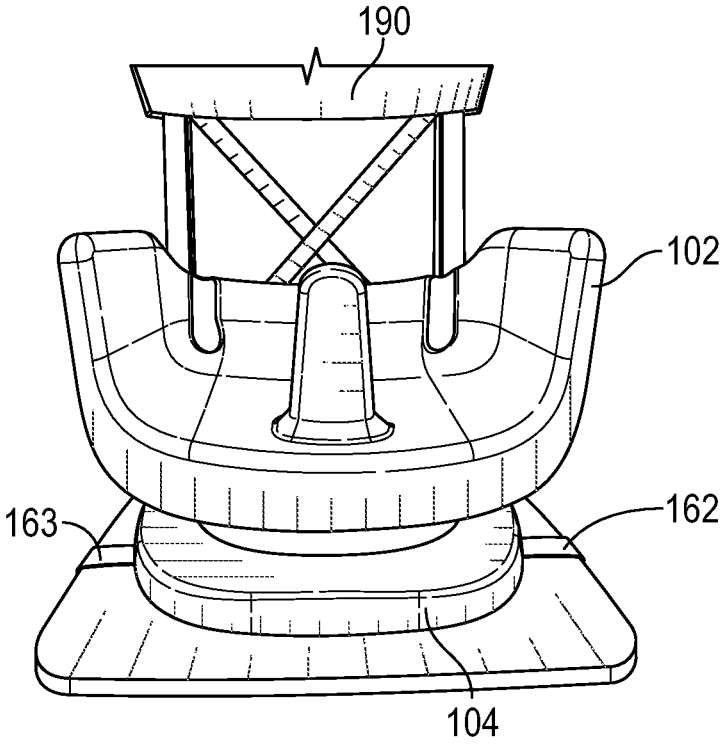
FIG. 1J is a partial perspective view of the convertible booster seat of FIG. 1A coupled to a conventional chair in accordance with one example embodiment of the disclosure.
Figure 1K:
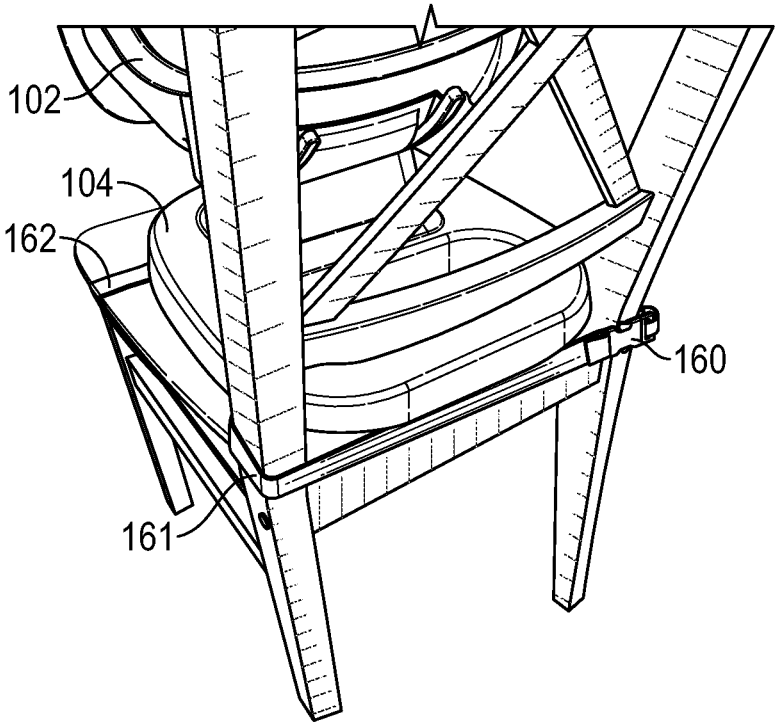
FIG. 1K is another partial perspective view of the convertible booster seat of FIG. 1A coupled to a conventional chair in accordance with one example embodiment of the disclosure.

FIGS. 1J-1K are partial front and perspective views of the convertible booster seat 100 of FIGS. 1A-1K coupled to a conventional chair 190 in accordance with one example embodiment of the disclosure. As best shown in FIGS. 1I-1J, the convertible booster seat 100 can include a first webbing portion 162 coupled to the webbing aperture 158 and a second webbing portion 163 coupled to the webbing aperture 156. The first webbing portion 162 can be removably coupled to the second webbing portion 163. For example, both the first webbing portion 162 and the second webbing portion 163 can be removably coupled around a seat bottom of a conventional chair 190 to help hold the convertible booster seat 100 in position on the chair 190. In one example, the first webbing portion 162 can include a latch plate on its free end and the second webbing portion 163 can include a buckle (or the latch plate and buckle can be switched) on its free end to removably couple to two webbing portions 162, 163 together. Other known techniques for removably coupling the first webbing portion 162 to the second webbing portion 163 can also be used.

In addition, as best shown in FIGS. 1I and 1K, the convertible booster seat 100 can also include a third webbing portion 160 coupled to the webbing aperture 152 and a fourth webbing portion 161 coupled to the webbing aperture 154. The third webbing portion 160 can be removably coupled to the fourth webbing portion 161. For example, as shown in FIG. 1K, both the third webbing portion 160 and the fourth webbing portion 161 can be removably coupled around a seat back of a conventional chair 190 to help hold the convertible booster seat 100 in position on the chair 190. In one example, the third webbing portion 160 can include a latch plate on its free end and the fourth webbing portion 161 can include a buckle (or the latch plate and buckle can be switched) on its free end to removably couple to two webbing portions 160, 161 together. Other known techniques for removably coupling the third webbing portion 160 to the fourth webbing portion 161 can also be used.

The seat base 104 can also include a pedestal portion 105 that extends generally vertically up from a top side of the seat base 104 and is positioned between the bottom of the seat base 104 and the seat shell 102. In other example embodiments, a pedestal portion may not be included. For example, in other examples, the outer facing side walls of the seat shell 102 can extend generally vertically downward to the flat or substantially level bottom surface of the seat base 104 without a pedestal 105 therebetween.

As discussed above, in certain example embodiments, the seat shell 102 is movably coupled to the seat base 104 such that the seat shell 102 can rotate, move, or tilt/recline with respect to the seat base 104. In one example embodiment, the top end of the pedestal 105 can include a first track 191 and a second track 193. In one example, each of the first and second tracks 191, 193 can have a corresponding arcuate shape and can extend longitudinally from near the front of the pedestal 105 to near the back of the pedestal 105. The first track 191 can include multiple pin receiving apertures 159 that extend into the first track 191 orthogonally to the longitudinal axis of the first track 191. The second track 193 can also include multiple pin receiving apertures 161 that extend into the second track 193 orthogonally to the longitudinal axis of the second track 193. The pin receiving apertures 159, 161 can provide 2, 3, 4, or more recline positions for the seat bottom 102 with respect to the seat base 104 and pedestal 105.

A bottom side of the seat shell can also include a first rail 127 and a second rail 129. In one example, each of the first rail 127 and the second rail 129 can have a corresponding arcuate shape and can extent longitudinally from near the front of the seat shell 102 towards the back of the seat shell 102. The first rail 127 can be configured to receive at least a portion of and/or ride along the first track 191. The second rail 129 can be configured to receive at least a portion of and/or ride along the second track 193. The first and second rails 127, 129 riding along the first and second tracks 191, 193 allow for the seat shell to recline or tilt with respect to the seat base 104.

The bottom side of the seat shell 102 can also include a release lever 125, a first recline pin 151 operably, directly or indirectly, coupled to the release lever 125 and a second recline pin 153 operably, directly or indirectly, coupled to the release lever 125. In one example, a wire 155 can include a first end coupled to the release lever 125 and a distal second end coupled to the first recline pin 151 to couple the release lever 125 to the first recline pin 151. Further, in this example, a wire 157 can include a first end coupled to the release lever 125 and a distal second end coupled to the second recline pin 153.

The release lever 125 can generally move along an axis extending from the front to the back of the seat shell 102 in the directions E and F. In certain examples, the release lever 125 can also include a spring or other biasing device to spring-bias the release lever 125 in the direction F. When a user applies a force to move the release lever 125 in the direction E, tension is created in the wires 155, 157 that pull the first recline pin 151 and second recline pin 153 inward towards one another to remove the first recline pin 151 from one of the pin receiving apertures 161 and to remove the second recline pin 153 from one of the pin receiving apertures 159, thereby releasing the seat shell 102 to move, rotate, tilt/recline in the directions C and D with respect to the seat base 104. Once the desired position of the seat shell 102 with respect to the seat base 104 is achieved, the user can discontinue applying a force on the release lever in the direction E. The spring or other spring-biasing device will cause apply a force on the release lever 125 to move the release lever 125 in the direction F. Movement of the release lever 125 in the direction F, will reduce tension on the wires 155, 157 and cause each of the first recline pin 151 and second recline pin 153 to move outward, away from one another and allow the first recline pin 151 to be inserted into one of the pin receiving apertures 171 and allow the second recline pin 153 to be inserted into one of the pin receiving apertures 159 to lock the seat shell 102 into position with respect to the seat base 104. While the example embodiment herein describes the use of a release lever, other devices, such as a push-button, pull tab, slider, rotatable knob or the like.

The convertible booster seat 100 can also include soft goods (e.g., any combination of fabric material, plastic material, leather material, pleather material, see-through mesh material, padding, or any other material used for soft goods and known to those of ordinary skill in the art). The soft goods can be removably coupled to and decoupled from the convertible booster seat 100. For example, the soft goods 100 can include seat back soft goods 116, seat bottom soft goods 118, first side panel soft goods 120 and second side panel soft goods 122. The seat back soft goods 116, seat bottom soft goods 118, first side panel soft goods 120, and second side panel soft goods 122 can be integrally formed together or separately formed and coupled together.

The seat back soft goods 116 is configured to be positioned along the second seat back portion 106 of the booster seat 100 and configured to receive a child's back thereon. The seat back soft goods 116 can be removably coupled to the seat back frame 130. For example, the seat back soft goods 116 can include a front soft goods panel, a rear soft goods panel, and a cavity disposed between the front soft goods panel and the rear soft goods panel. The cavity can be configured to receive the seat back frame 130 slidably therein to couple the seat back soft goods 116 to the seat back frame 130.

The seat bottom soft goods 118 can be fixedly coupled to a bottom end of the seat back soft goods 116. The seat bottom soft goods 118 can be configured to cover all or a portion of the seat bottom 110 of the seat shell 102 to increase the comfort for a child sitting on the seat bottom 110. The seat bottom soft goods 118 can be removably coupled to the seat bottom 110 and/or the crotch post 113 using known coupling means including any one or more of buttons/button holes, hooks/eyelets, tabs/slots, snap fasteners, one or more pliable bands, or Velcro.

The first side panel soft goods 120 can be fixedly coupled to the seat back soft goods 116 and/or the seat bottom soft goods 118. For example, the first side panel soft goods 120 can extend from one lateral side of the seat bottom soft goods 118 and can cover all or a portion of an inner-facing wall of the first side panel 112. The first side panel soft goods 120 can be removably coupled to the first side panel 112 using known coupling means including any one or more of buttons/button holes, hooks/eyelets, tabs/slots, snap fasteners, one or more pliable bands, or Velcro. The second side panel soft goods 122 can be fixedly coupled to the seat back soft goods 116 and/or the seat bottom soft goods 118. For example, the second side panel soft goods 122 can extend from a second lateral side of the seat bottom soft goods 118 and can cover all or a portion of an inner-facing wall of the second side panel 114. The second side panel soft goods 122 can be removably coupled to the second side panel 114 using known coupling means including any one or more of buttons/button holes, hooks/eyelets, tabs/slots, snap fasteners, one or more pliable bands, or Velcro.

The seat back soft goods 116 can include two or more harness apertures 126 through the front soft goods panel of the seat back soft goods 116 for receiving portions of a child restraint harness 124 (e.g., a shoulder harness and one or more latch plates) therethrough. In certain example embodiments, multiple pairs of harness apertures 126 can be provided at different heights along the seat back soft goods 116 for use with children of different heights in the convertible booster seat 100. In addition, the seat bottom soft goods 118 can include one or more harness apertures (not shown) through the soft goods for receiving another portion of the restraint harness (e.g., a buckle) therethrough. The restraint harness 124 can be a 3-point harness or a 5-point harness in certain example embodiments. The two portions of the restraint harness 124 can be removably coupled to one another using known coupling devices (such as buckles and latches) to restrain the child within the convertible booster seat to prevent injury.

In certain example embodiments, the seat back soft goods 116, seat bottom soft goods 118, first side panel soft goods 120, and second side panel soft goods 122 are fixedly coupled or integrally formed as a single soft goods panel that a user can easily couple to and decouple from the seat shell 102 and the second seat back portion 106. As such, when the second seat back portion 106 is removed and separated from the seat shell 102, the seat back soft goods 116, seat bottom soft goods 118, first side panel soft goods 120, and second side panel soft goods 122 can be removed with the second seat back portion 106 and can be used separately with the second seat back portion in a travel configuration.

Figure 2A:
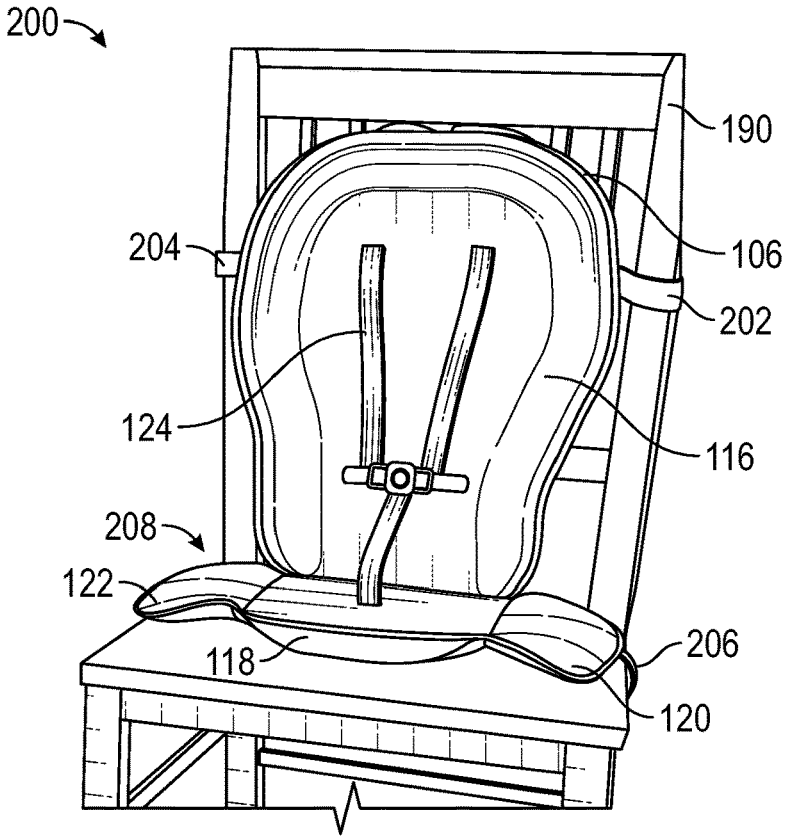
FIG. 2A is a perspective view of the convertible booster seat of FIG. 1A in the travel configuration in accordance with one example embodiment of the disclosure.
Figure 2B:
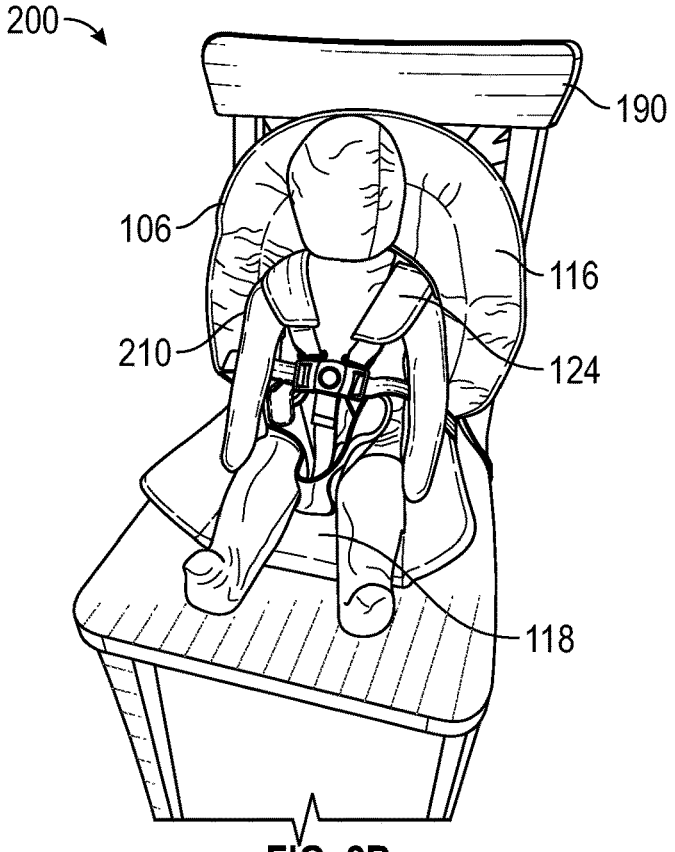
FIG. 2B is a perspective view of the convertible booster seat of FIG. 1A in the travel configuration with a child thereon in accordance with one example embodiment of the disclosure.
Figure 2C:
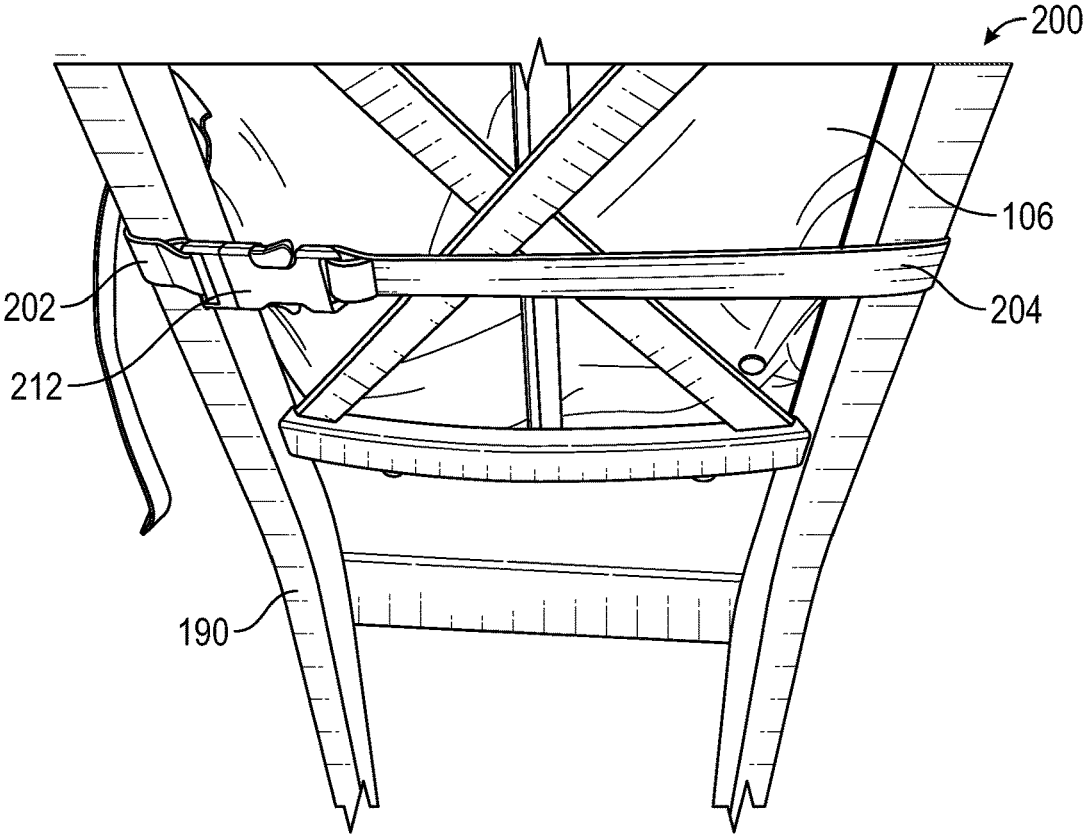
FIG. 2C is a partial perspective view of the convertible booster seat of FIG. 1A in the travel configuration and coupled to a conventional chair in accordance with one example embodiment of the disclosure.

As discussed above, the convertible booster seat 100 can be converted into a number of useful configurations. FIGS. 1A-1B present the convertible booster seat 100 in the home booster, or full, configuration. FIGS. 2A-2C are various views of the convertible booster seat of FIG. 1A in the travel configuration 200 in accordance with one example embodiment of the disclosure. In one example embodiment, to adjust the convertible booster seat 100 from the home booster configuration to the travel configuration 200, the second seat back portion 106 is decoupled from the first frame receiving aperture 142 and the second frame receiving aperture 144 on the seat shell 102 as discussed above. The seat bottom soft goods 118 can also be decoupled from the crotch post 113 or another portion of the seat bottom 110 or the bottom side of the seat shell 102. The first side panel soft goods 120, and second soft panel soft goods 122 can also be decoupled (if originally coupled at all) from the first side panel 112, and second side panel 114 respectively or from another area along the seat shell 102. When the second seat back portion 106 is decoupled from the seat shell 102, the seat back soft goods 116, seat bottom soft goods 118, first side panel soft goods 120, and second soft panel soft goods 122 are removed with the second seat back portion 106 and kept with the second seat back portion 106. In addition, the restraint harness 124 is also removed with the second seat back portion 106 for use in the travel configuration 200.

In the travel configuration 200, the second seat back portion 106 can be positioned abutting and adjacent to the seat back of a conventional chair 190. The seat bottom soft goods 118, first side panel soft goods 120, and second side panel soft goods 122, can be positioned abutting and on top of the seat bottom of a conventional chair, such that the soft goods are in direct contact with the seat bottom of the conventional chair. Thus, in the travel configuration 200, the second seat back portion 106, with seat back frame 130 can provide a softened and contoured seat back for a child 210 and the seat bottom soft goods 118, first side panel soft goods 120, and second side panel soft goods 122 can provide a softer, more comfortable seating surface for the child 210 on the conventional chair 190. The soft goods 116, 118, 120, 122, can also provide a certain amount of protection to the chair from stains that may occur while the child 210 is eating.

In another embodiment, the second seat back portion 106, including the seat back frame 130 is not included in the travel configuration. Rather, the seat back soft goods 116 is removed from the second seat back portion 106 along with the seat bottom soft goods 118, first side panel soft goods 120, and second soft panel soft goods 122. In this other embodiment, the seat back soft goods 116, without the second seat back portion 106, can be positioned abutting and adjacent to the seat back of a conventional chair 190. The seat bottom soft goods 118, first side panel soft goods 120, and/or second side panel soft goods 122, can be positioned abutting and on top of the seat bottom of the conventional chair 190, such that the soft goods are in direct contact with the seat bottom of the conventional chair 190. Thus, in the travel configuration 200, the seat back soft goods 116, without the seat back frame 130, can provide a softened seat back for a child 210 and the seat bottom soft goods 118, first side panel soft goods 120, and second side panel soft goods 122 can provide a softer, more comfortable seating surface for the child 210 on the conventional chair 190. The soft goods 116, 118, 120, 122, can also provide a certain amount of protection to the chair from stains that may occur while the child 210 is eating.

In any of the example embodiments of the travel configuration 200, the seat back soft goods 116 can also include a first webbing portion 202 (e.g., a strap) and a second webbing portion 204 (e.g., a strap). In one example, one or both of the first webbing portion 202 and the second webbing portion 204 can be coupled to the harness mount 199 (FIG. 1C) on the seat back frame 130 (e.g., the second frame member 130B). If only one of the first webbing portion 202 and the second webbing portion 204 is coupled to the harness mount 199, then the other webbing portion can be coupled either the first lateral side or the second lateral side of the seat back soft goods 116. In another example embodiment, the first webbing portion 202 can be coupled to a first lateral side of the seat back soft goods 116 and the second webbing portion 204 can be coupled to a second lateral side of the seat back soft goods 116.

The first webbing portion 202 can be removably coupled to the second webbing portion 204. For example, as shown in FIGS. 2A and 2C, both the first webbing portion 202 and the second webbing portion 204 can be removably coupled around a seat back of a conventional chair 190 to help hold the second seat back portion 106 in position on the chair 190 in the travel configuration. In one example, the first webbing portion 202 can include a latch plate and the second webbing portion 204 can include a buckle 212 (or the latch plate and buckle can be switched) to removably couple to two webbing portions 202, 204 together. Other known techniques for removably coupling the first webbing portion 202 to the second webbing portion 204 can also be used.

In the travel configuration 200, the soft goods can also include a third webbing portion 206 (e.g., a strap) coupled to a lateral side of the first side panel soft goods 120 and a fourth webbing portion 208 coupled to a lateral side of the second side panel soft goods 122. The third webbing portion 206 can be removably coupled to the fourth webbing portion 208. For example, as shown in FIG. 2A, both the third webbing portion 206 and the fourth webbing portion 208 can be removably coupled around a seat bottom of a conventional chair 190 to help hold the seat bottom soft goods 118 in position on the seat bottom of the chair 190 in the travel configuration 200. In one example, the third webbing portion 206 can include a latch plate and the fourth webbing portion 208 can include a buckle (or the latch plate and buckle can be switched) to removably couple to two webbing portions 206, 208 together. Other known techniques for removably coupling the third webbing portion 206 to the fourth webbing portion 208 can also be used.

Figure 2D:
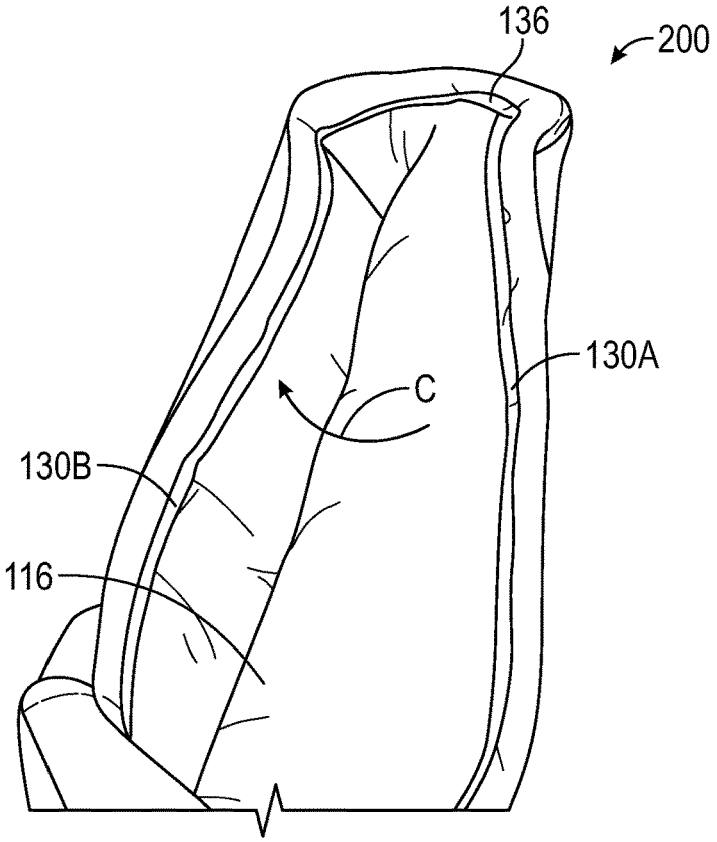
FIG. 2D is a partial perspective view of the seat back of the convertible booster seat of FIG. 1A in a folded configuration for storage and travel in accordance with one example embodiment of the disclosure.

In one example embodiment, for purposes of storage during travel, when the travel configuration 200 includes the second seat back portion 106 with the seat back frame 130, the second seat back portion 106 can be folded as shown in FIG. 2D. As discussed above with reference to FIG. 1C, the seat back frame 130 can include a first frame portion 130A that is rotatable with respect to a second frame portion 130B. When the seat back soft goods 116 are still attached to the seat back frame 130, the seat back frame 130 can be folded about the rotation axis A or B to fold the seat back frame 130 and soft goods 116 into a smaller configuration for storage or travel. In other embodiments, where the travel configuration does not include the second seat back portion 106 or seat back frame 130 but includes the seat back soft goods 116, folding of the seat back soft goods 116 along with the other soft goods portions can be achieved in a number of ways given that this embodiment of the travel configuration is almost entirely made up of soft goods. The second seat back portion 106 and the soft goods can then be stored into a carry-bag sized and shaped to receive the folded elements.

Figure 3A:
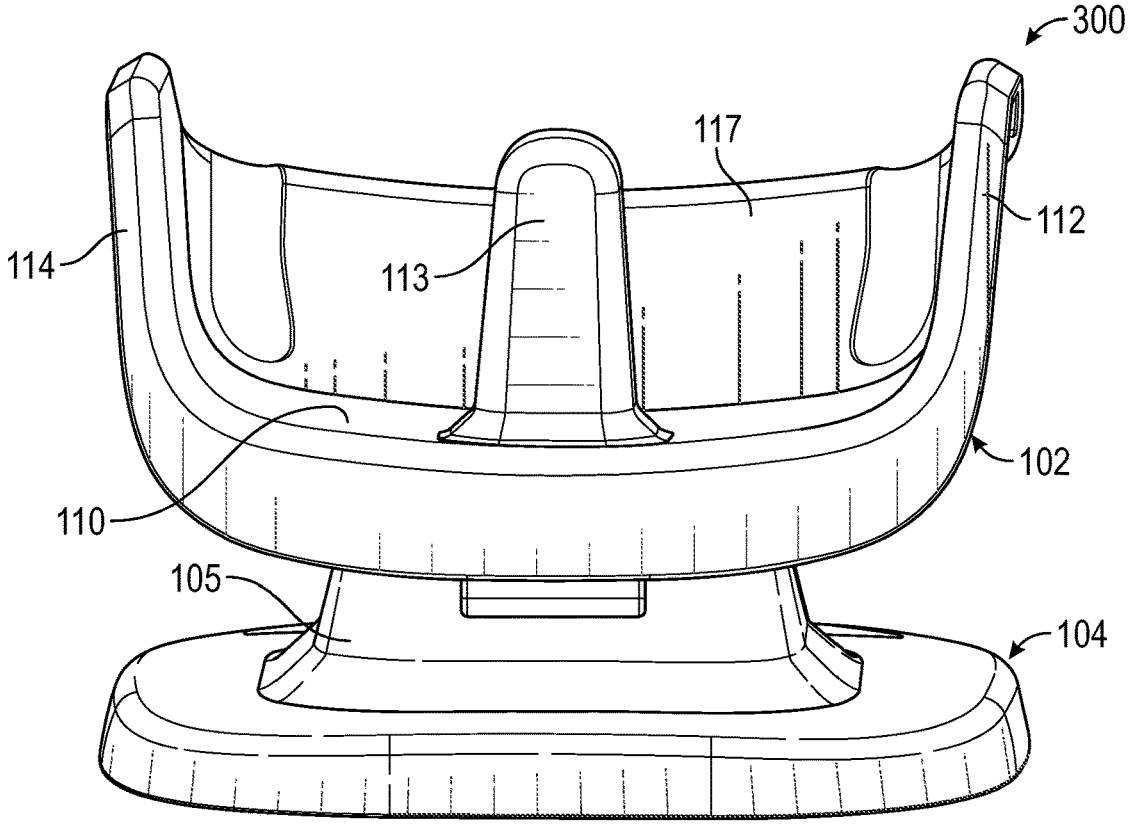
FIG. 3A is a front elevation view of the convertible booster seat of FIG. 1A in a backless booster seat configuration in accordance with one example embodiment of the disclosure.
Figure 3B:
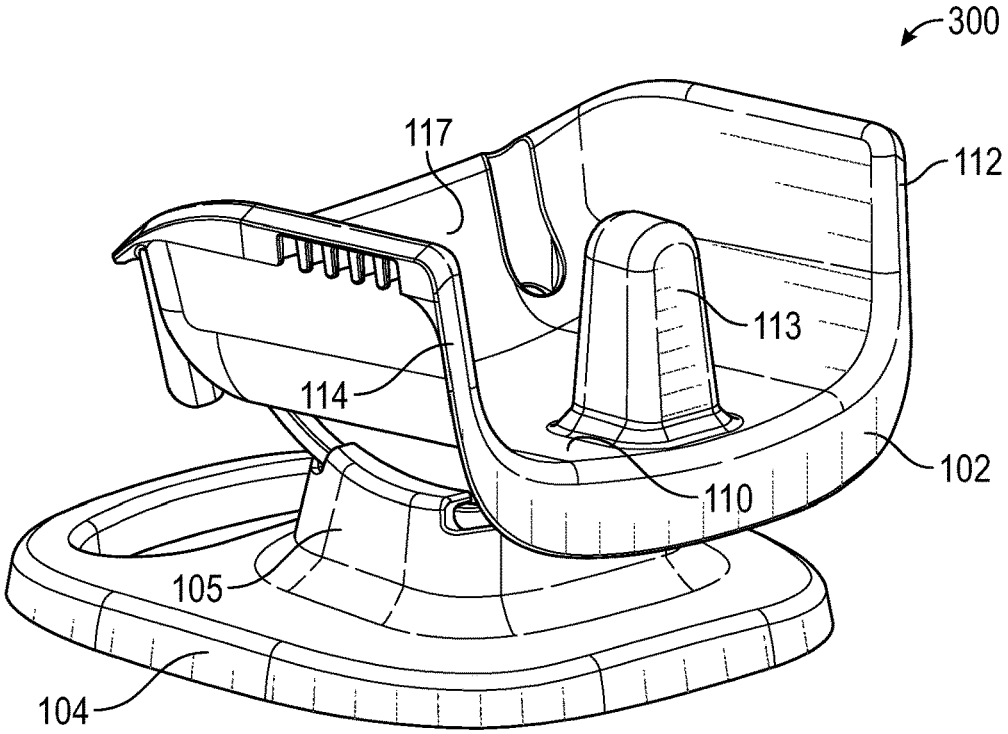
FIG. 3B is a front perspective view of the convertible booster seat of FIG. 1A in a backless booster seat configuration in accordance with one example embodiment of the disclosure.
Figure 5A:
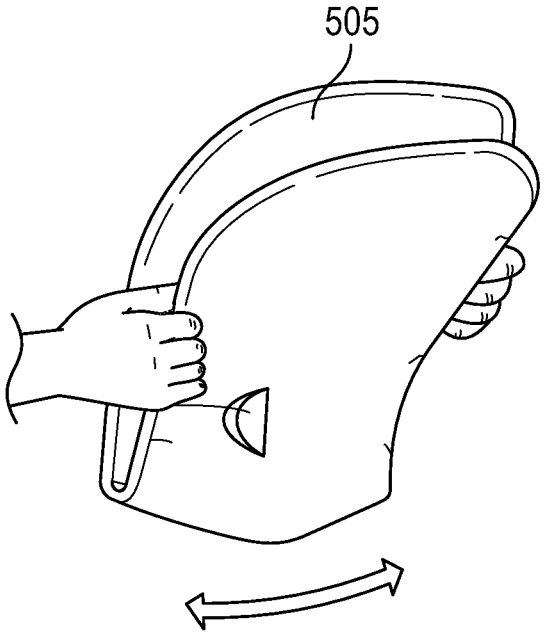
Figure 5B:
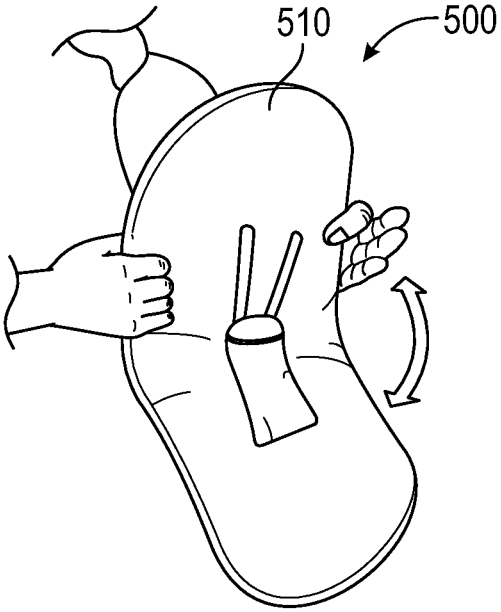
Figure 5C:
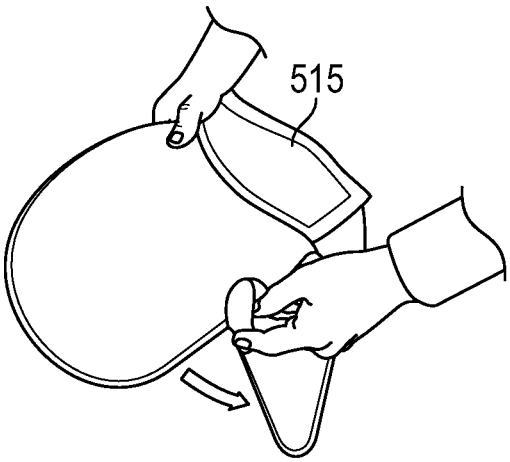
Figure 5D:
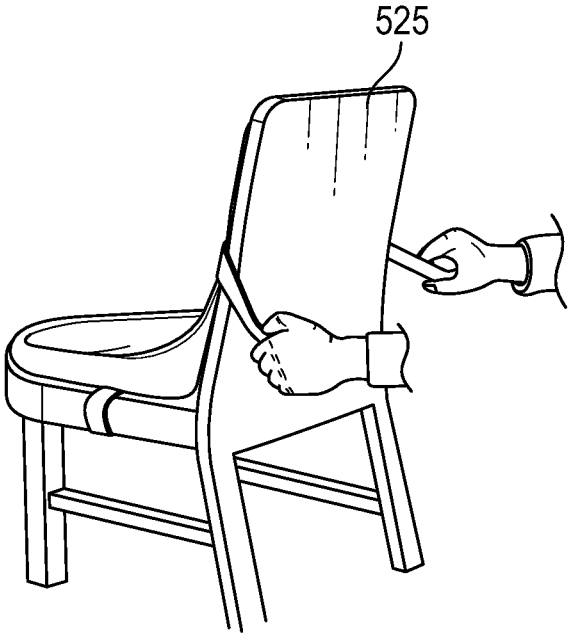
Figure 6A:
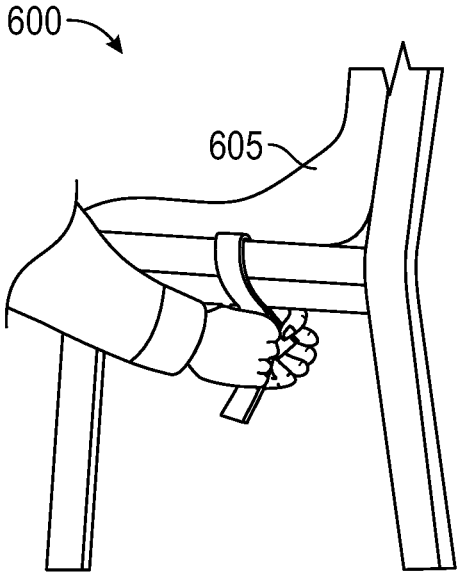
FIGS. 6A-6D are a series of images presenting a method for converting the convertible booster seat of FIG. 1A from the travel booster configuration to a folded configuration for travel and/or storage in accordance with one example embodiment of the disclosure.
Figure 6B:
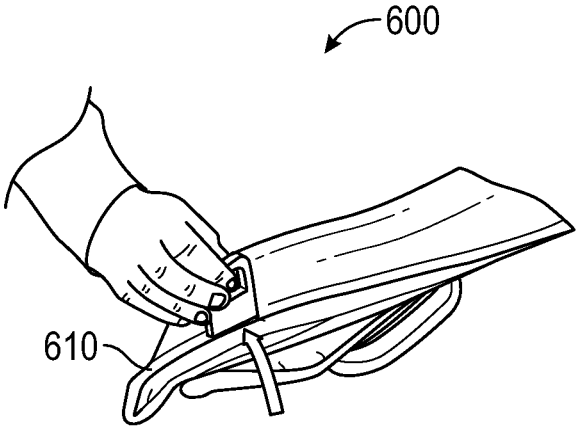
Figure 6C:
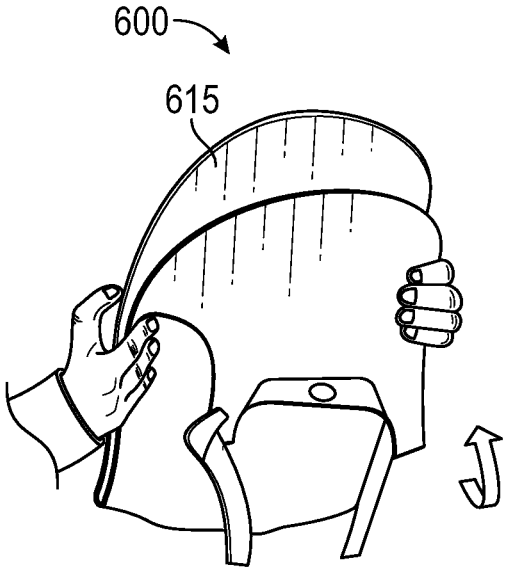
Figure 6D:
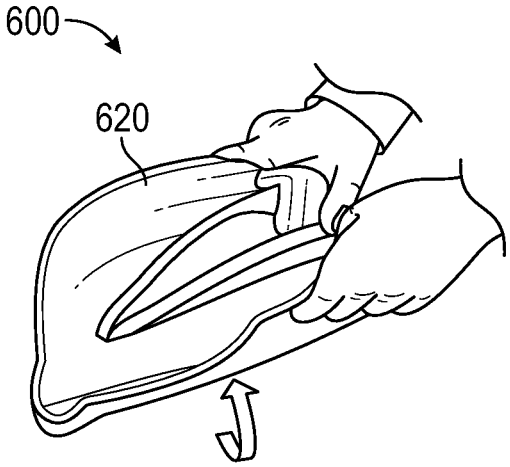

As discussed above, the convertible booster seat 100 can be converted into a number of useful configurations. FIGS. 1A-1B present the convertible booster seat 100 in the home booster, or full, configuration and FIGS. 2A-2D present the convertible booster seat in the travel configuration. FIGS. 3A-3B are front elevation and perspective views of the convertible booster seat of FIG. 1A in a backless booster seat configuration 300 in accordance with one example embodiment of the disclosure. Referring to FIGS. 1A-1G and 3A-3B, the backless booster seat configuration 300 can typically be used for older toddlers who no longer need the second seat back portion 106 and/or restraint harness 124 to maintain the child in the booster seat. Providing a booster seat that is convertible from the home booster configuration of 100 to the backless booster seat configuration 300 extends the useful life of the booster seat to the user as the child grows up and becomes bigger. In certain instances, the booster seat shown in the various embodiments may be referred to as a "child seat" or "child feeding seat", and similar configurations and features can be applied to and implemented with a children's "high chair", also known as a "child seat" or "child feeding seat". One skilled in the art will recognize that the various configurations and features for a booster seat can be applied to and implemented with a children's high chair or other child seat.

In one example embodiment, the backless booster seat configuration 300 can include the seat shell 102, including the seat bottom 110, first side panel 112, second side panel 114 and first seat back portion 117 (as each is described with reference to FIGS. 1A-1K), and the seat base 104. The second seat back portion 106, seat back soft goods 116, seat bottom soft goods 118, first side panel soft goods 120, and second side panel soft goods 122 have been removed and may not be used in the backless booster seat configuration 300. In other example embodiments, the seat bottom soft goods 118, first side panel soft goods 120, and second side panel soft goods 122 may be coupled to the seat bottom 110 and/or crotch post 113, first side panel 112, and second side panel 114 respectively. The backless booster seat configuration 300 can also include the first webbing 160, second webbing 161, third webbing 162, and fourth webbing 163 for removably coupling the seat base 104 to the seat back and seat bottom of the conventional chair 190.

FIGS. 4A-4E and 5A-5D are a series of images presenting methods for converting the convertible booster seat of FIG. 1A from a home booster configuration 100 to a travel booster configuration 200 in accordance with one example embodiment of the disclosure. Referring now to FIGS. 1A-2D, 4A-4E, and 5A-5D, the method 400 begins at block 405 of FIG. 4A, where a crotch strap that is part of the restraint harness 124 is decoupled from the seat bottom 110 of the seat shell 102. At block 410 of FIG. 4B, the second seat back portion 106 (e.g., the seat back frame 130) is decoupled from the receiving slots 142, 144 of the seat shell 102, and the seat back soft goods 116, seat bottom soft goods 118, first side panel soft goods 120, second side panel soft goods 122, and the seat back frame 130 are removed from the seat shell 102. At blocks 415 and 420 of FIGS. 4C-4D, the seat bottom soft goods 118, first side panel soft goods 120, and second side panel soft goods 122 are folded up towards the second seat back portion 106 (e.g., the seat back frame 130) and seat back soft goods 116. At block 425 of FIG. 4E, the second seat back portion 106 is adjusted from an unfolded configuration to a folded configuration by rotating the first seat back frame portion 130A with respect to the second seat back frame portion 130B about the rotation axis A or B of the hinge 136. The folded elements can then be placed into a bag (not shown) for storage and travel.

The method 500 begins with removing the folded elements (e.g., the seat back soft goods 116, the seat bottom soft goods 118, first side panel soft goods 120, second side panel soft goods 122, and the seat back frame 130) are removed from the bag (not shown). At block 505 of FIG. 5A, the second seat back portion 106 (e.g., the seat back frame 130) is adjusted from the folded configuration to the unfolded configuration by rotating the first seat back frame portion 130A with respect to the second seat back frame portion 130 about the rotation axis A or B of the hinge 136. At block 510 of FIG. 5B, the seat bottom soft goods 118, first side panel soft goods 120, and second side panel soft goods 122 are unfolded down and away from the second seat back portion 106 and seat back soft goods 116 into a use configuration. At block 515 of FIG. 5C, the third webbing portion 206 can be removed from one or more storage areas or cavities in the first side panel soft goods 120 and the fourth webbing portion 208 can be removed from one or more storage areas or cavities in the second side panel soft goods 122. At block 520 of FIG. 5D, the second seat back portion 106, with frame 130 and seat back soft goods 116 is placed abutting and adjacent to a seat back of a conventional chair 190 and the seat bottom soft goods 118, first side panel soft goods 120 and second side panel soft goods 122 are placed upon and abutting the seat bottom of the conventional chair 190. The first webbing portion 202 and second webbing portion 204 can be coupled about the seat back of the chair 190 and the third webbing portion 206 and fourth webbing portion 208 can be coupled together about the seat bottom of the chair 190 to maintain the booster seat in the travel configuration 200 safely to the chair 190.

FIGS. 6A-6D are a series of images presenting a method for converting the convertible booster seat of FIG. 1A from the travel booster configuration 200 to a folded configuration for travel and/or storage in accordance with one example embodiment of the disclosure. Referring now to FIGS. 1A-2D, and 6A-6D, the method 600 begins at block 605 of FIG. 6A, where the first webbing portion 202 is decoupled from the second webbing portion 204 about the seat back of the seat 190 and the third webbing portion 206 is decoupled from the fourth webbing portion 208 about the seat bottom of the chair 190 to decouple the travel booster configuration 200 from the chair 190. At block 610 of FIG. 6B, the third webbing portion 206 can be stored in one or more storage areas or cavities in the first side panel soft goods 120 and the fourth webbing portion 208 can be stored in one or more storage areas or cavities in the second side panel soft goods 122 and the first webbing portion 202 and the second webbing portion 204 can be coupled together along the back side of the seat back soft goods 116. At block 615 of FIG. 6C, the seat bottom soft goods 118, first side panel soft goods 120, and second side panel soft goods 122 are folded up towards the second seat back portion 106 (e.g., the seat back frame 130) and seat back soft goods 116. At block 620 of FIG. 6D, the second seat back portion 106 is adjusted from an unfolded configuration to a folded configuration by rotating the first seat back frame portion 130A with respect to the second seat back frame portion 130B about the rotation axis A or B of the hinge 136. The folded elements (e.g., the seat back soft goods 116, the seat bottom soft goods 118, first side panel soft goods 120, second side panel soft goods 122, and the seat back frame 130) can then be placed into a bag (not shown) for storage and travel.

Though the disclosed examples include particular arrangements of a number of parts, components, features, and aspects, the disclosure is not limited to only those examples or arrangements shown. Any one or more of the parts, components, features, and aspects of the disclosure can be employed alone or in other arrangements of any two or more of the same.

Although certain booster seat features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. An apparatus comprising:

a child feeding seat configured to be adjusted from and for use in both a full configuration comprising soft goods, a rigid seat shell defining a seat bottom, and a seat back comprising a rigid frame removably coupled to a rear edge of the seat shell, wherein the soft goods covers both the seat shell and the seat back frame and is removably coupled to the seat shell with the seat back frame, the seat back comprising a hinge connecting a first rotatable seat back frame member to a second rotatable seat back frame member; and further configured to be adjusted to a travel configuration comprising the seat back frame and the soft goods without the seat shell; wherein the seat shell and the seat back frame are rigid relative to the soft goods, and the seat back comprises a portion of the soft goods that covers the seat back frame.

2. The apparatus of claim 1, wherein the seat back covers at least a portion of the seat shell in the full configuration.

3. The apparatus of claim 1, wherein the seat shell comprises:

a first side panel extending up from a first lateral side of the seat bottom;

a second side panel extending up from a second lateral side of the seat bottom opposite the first lateral side; and a first seat back portion extending up from a rear side of the seat bottom.

4. The apparatus of claim 3, wherein the seat back is removably coupled to the first seat back portion.

5. The apparatus of claim 3, wherein the seat back comprises:

the portion covering the seat back frame and a portion covering the first seat back portion;

a seat bottom soft goods portion covering at least a portion of the seat shell;

a first side panel soft goods portion covering at least a portion of the first side panel; and a second side panel soft goods portion covering at least a portion of the second side panel.

6. The apparatus of claim 1, further comprising a seat base coupled to the seat shell, wherein the seat base comprises a bottom surface configured to abut a seat bottom of a chair.

7. The apparatus of claim 6, wherein the seat base comprises a pedestal portion extending up from a first portion of the seat base, wherein the pedestal portion is coupled to the seat shell.

8. The apparatus of claim 6, wherein the seat shell is configured to pivot about a horizontal axis with respect to the seat base.

9. The apparatus of claim 1, wherein the seat back comprises a seat frame configured to be adjusted from an unfolded configuration to a folded configuration.

10. The apparatus of claim 1, wherein, in the travel configuration, the seat back comprises:

a seat bottom soft goods portion configured to cover at least a portion of a seat bottom of a conventional chair.

11. The apparatus of claim 1, wherein the child feeding seat is further configured to be adjusted from the full configuration to and for use in a backless booster seat configuration comprising the seat shell and a seat base without the seat back.

12. An apparatus comprising:

a child seat configured to be adjusted from and for use in both a full configuration comprising soft goods, a rigid seat shell defining a seat bottom, and a seat back comprising a rigid frame removably coupled to a rear edge of the seat shell, wherein the soft goods covers both the seat shell and the seat back frame and is removably coupled to the seat shell with the seat back frame, the seat back comprising a hinge connecting a first rotatable seat back frame member to a second rotatable seat back frame member; and further configured to be adjusted to a travel configuration comprising the seat back frame and the soft goods without the seat shell; wherein the seat shell and the seat back frame are rigid relative to the soft goods, and the seat back comprises a portion of the soft goods that covers the seat back frame; and wherein the seat shell comprises:

a first side panel extending up from a first lateral side of the seat bottom;

a second side panel extending up from a second lateral side of the seat bottom opposite the first lateral side; and a first seat back portion extending up from a rear side of the seat bottom;

wherein the apparatus further comprises a seat frame.

13. The apparatus of claim 12, wherein the seat back is removably coupled to the first seat back portion.

14. The apparatus of claim 12, wherein the seat shell is configured to pivot about a horizontal axis with respect to the seat base.

15. A method of converting a child seat comprising:

providing a child seat in a full configuration comprising soft goods, a rigid seat shell defining a seat bottom, and a seat back comprising a rigid frame removably coupled to a rear edge of the seat shell, wherein the soft goods covers both the seat shell and the seat back frame and is removably coupled to the seat shell with the seat back frame, the seat back comprising a hinge connecting a first rotatable seat back frame member to a second rotatable seat back frame member; and converting the child seat from the full configuration to a travel configuration comprising the seat back frame and the soft goods without the seat shell by removing the seat back and the soft goods from the seat shell, wherein the seat shell and the seat back frame are rigid relative to the soft goods, the seat back comprises a portion of the soft goods that covers the seat back frame, and at least a portion of the soft goods are configured to be positioned on a chair in the travel configuration.

16. The method of claim 15, further comprising:

converting the child seat from the full configuration to a backless child seat configuration comprising the seat shell and a seat base without the seat back.

17. The method of claim 16, wherein the seat shell comprises:

a first side panel extending up from a first lateral side of the seat bottom;

a second side panel extending up from a second lateral side of the seat bottom opposite the first lateral side; and a first seat back portion extending up from a rear side of the seat bottom.

* * * * *